US010443177B2

(12) United States Patent
Kim et al.

(10) Patent No.: US 10,443,177 B2
(45) Date of Patent: Oct. 15, 2019

(54) LAUNDRY TREATING APPARATUS

(71) Applicant: LG ELECTRONICS INC., Seoul (KR)

(72) Inventors: Mincheol Kim, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 78 days.

(21) Appl. No.: 15/671,352

(22) Filed: Aug. 8, 2017

(65) Prior Publication Data

US 2018/0038031 A1 Feb. 8, 2018

(30) Foreign Application Priority Data

Aug. 8, 2016 (KR) ..... 10-2016-0100804

(51) Int. Cl.

| | |
|---|---|
| ***D06F 37/06*** | (2006.01) |
| ***D06F 13/06*** | (2006.01) |
| ***D06F 37/26*** | (2006.01) |
| ***D06F 39/10*** | (2006.01) |
| *D06F 39/08* | (2006.01) |
| *D06F 23/04* | (2006.01) |
| *D06F 37/14* | (2006.01) |

(52) U.S. Cl.

CPC ..... *D06F 37/065* (2013.01); *D06F 13/06* (2013.01); *D06F 37/26* (2013.01); *D06F 39/10* (2013.01); *D06F 23/04* (2013.01); *D06F 37/145* (2013.01); *D06F 39/083* (2013.01)

(58) Field of Classification Search

CPC ..... B08B 9/093

See application file for complete search history.

(56) References Cited

U.S. PATENT DOCUMENTS

2011/0047714 A1 3/2011 Kim et al.

FOREIGN PATENT DOCUMENTS

| | | |
|---|---|---|
| CN | 1693571 | 11/2005 |
| CN | 202380285 | 8/2012 |
| CN | 203846309 | 9/2014 |
| JP | S60-145191 | 7/1985 |
| JP | 2005-192920 | 7/2005 |
| JP | 2006-263359 | 10/2006 |
| JP | 2009-131399 | 6/2009 |

OTHER PUBLICATIONS

Australian Office Action dated Oct. 30, 2018 issued in AU Application No. 2017213439.

Chinese Office Action (with English translation) dated Jun. 5, 2019 issued in CN Application No. 201710670150.7.

*Primary Examiner* — Jason Y Ko

(74) *Attorney, Agent, or Firm* — KED & Associates, LLP

(57) ABSTRACT

A laundry treating apparatus comprising a tub; a drum mounted in the tub; a passage provided in the drum and configured to allow water to flow from a first portion of the drum to a second portion of the drum; an agitator rotatably provided in the drum and configured to agitate the water held in the drum; and a filter device configured to filter the water flowing through the passage, wherein the filter includes a body defining a storage space; an inlet configured to allow water into the body from the passage; a filter provided in the body and configured to filter foreign substances from the water drawn into the body and release the water into the drum; and a plurality of projections projected from the body and configured to hold the filtered foreign substances to the body, wherein a cross-sectional area of the projected unit is 25% to 50% of a cross sectional area of the body area.

20 Claims, 8 Drawing Sheets

LAUNDRY TREATING APPARATUS

CROSS-REFERENCE TO RELATED APPLICATION(S)

Pursuant to 35 U.S.C. § 119(a), this application claims the benefit of earlier filing date and right of priority to Korean Application No. 10-2016-0100804, filed on Aug. 8, 2016 in Korea, the entire contents of which is hereby incorporated by reference herein in its entirety.

BACKGROUND

1. Field

The present disclosure relates to a laundry treating apparatus.

2. Background

In general, a laundry treating apparatus is an electric device configured to wash laundry. A related art laundry treating apparatus includes a cabinet defining an exterior; a tub mounted in the cabinet and holding wash water therein; a drum rotatably mounted in the tub and holding clothes (hereinafter, laundry); and an agitator rotatably mounted in the drum and configured to form water currents.

Meanwhile, one of related art laundry treating apparatuses further includes a passage unit provided in the drum and configured to move water to an upper region of the drum when the agitator is rotated; and a filter unit provided in the passage unit and configured to filter water. When the agitator is rotated in the drum, the water pushed by the agitator is drawn into the passage unit provided in an inner wall of the drum and the water drawn into the passage unit is filtered by the filter unit and re-supplied to the drum.

While such a process is repeated, foreign substances, such as lint for example are filtered by the filter unit and the washed clothes are able to remain clean. However, the filter unit provided in the related art laundry treating apparatus includes no member for providing passage resistance to the water drawn into the filter unit, so that the conventional laundry treating apparatus is structured for the water to flow in and out of the filter unit, without any resistance.

Accordingly, if the water containing such lint, foreign substances or the like (hereinafter, lint) is drawn into the filter unit, lint floats in the filter unit and is collected on a surface or bottom of the filter unit once the water is drained from the filter unit. When such a process is repeated, the lint remains in the filter unit whenever the water is drawn into the filter unit and more lint accumulates on the bottom of the filter unit.

In this instance, the lint stuck on the surface of the filter unit is collected in the bottom of the filter unit by its weight and the lint accumulates on the bottom of the filter unit. Even if the filter unit of the related art laundry treating apparatus has a large capacity, the lint is likely to accumulate only on the bottom of the filter unit and the capacity of the filter unit for accommodating the lint is not increased disadvantageously.

Moreover, as the lint accumulates on the bottom of the filter unit, water or new lint might be stopped from getting into the filter unit of the related art laundry treating apparatus disadvantageously. Also, as the lint accumulates on the bottom of the filter unit, the lint might escape the filter unit only to be re-drawn into the drum. Accordingly, the laundry might be contaminated by the re-drawn lint into the drum disadvantageously. Meanwhile, the related art laundry treating apparatus has another disadvantage that the lint might float in the water remaining in the filter unit, because the water fails to be drained from the filter unit quickly.

BRIEF DESCRIPTION OF THE DRAWINGS

Embodiments will be described in detail with reference to the following drawings in which like reference numerals refer to like elements, and wherein.

DETAILED DESCRIPTION

Figure 1:
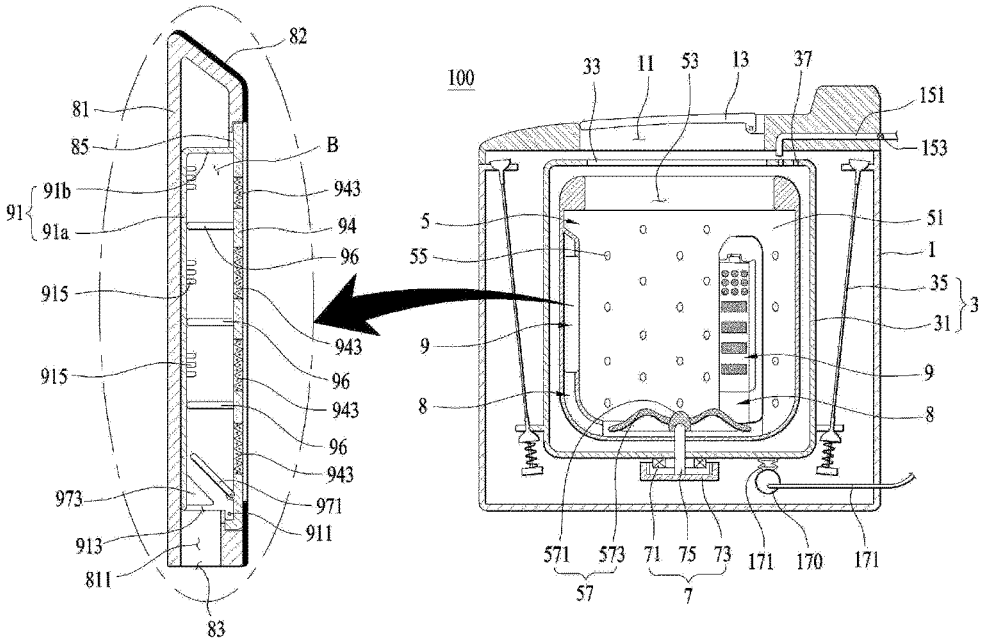
FIG. 1 is a diagram illustrating one example of a laundry treating apparatus in accordance with the present disclosure.

As shown in FIG. 1, a laundry treating apparatus in accordance with the present disclosure may include a cabinet 1; a tub 3 provided in the cabinet 1 and holding water therein; and a drum 5 provided in the tub and holding laundry. The cabinet 1 may include an opening 11 for loading or unloading laundry into or out of the drum 5; and a door 13 for opening and closing the opening 11.

The tub 3 may include a tub body 31 defining a predetermined space in which water is held and the tub body 31 may be fixed in the cabinet 1 via a tub support unit (or suspension) 35. A tub opening 33 may be provided in a top surface of the tub body 31, in communication with the opening 11.

The tub body 31 may be supplied with water by a water supply unit. The water supply unit may include a water supply pipe 151 connected to the water supply source and a valve 153 for opening and closing the water supply pipe. When the water supply pipe 151 is located in an upper region of the tub body 31, the tub body 31 may further include a water supply hole 37 for drawing the water supplied from the water supply pipe 151 into the tub body 31. The water supply hole 37 may penetrate the top surface of the tub body 31.

The water stored in the tub body 31 may be drained outside the cabinet 1 via a drainage unit. The drainage unit may include a drainage pipe 171 for guiding the water held in the tub body 31 outside the cabinet and a drainage pump 173.

The drum 5 may include a drum body 51 defining a predetermined space in which the laundry is stored. The drum body 51 may be rotatably mounted in the tub body 31 and able to communicate with the opening 11 via a drum opening 53. A plurality of drum penetrating holes 55 may be provided in a circumferential surface and a bottom surface of the drum body 51 to draw the water inside the tub body 31 into the drum body 51.

The drum 5 may further include an agitator unit (or agitator) 57 rotatably provided in the drum body 51. When the agitator unit 57 is rotated, water currents may be generated in the drum body 51.

The agitator unit 57 may be rotated by a drive unit (or drive) 7. The drive unit may include a stator 71 fixed to an outer surface of the tub body 31 and configured to generate a rotating magnetic field, a rotor 73 rotatable by the rotating magnetic field and a rotation shaft 75 connecting the agitator unit 57 and the rotor with each other via the bottom surface of the tub body 31.

The rotation shaft 75 may be perpendicularly arranged with respect to the bottom surface of the tub body 31. The agitator unit 57 may include a hub 751 fixed to the rotation shaft 75 and a vane 573 radially arranged with respect to the hub.

Once the agitator unit 57 is rotated by the drive unit 7, the water stored in the drum body 51 may flow along a rotational direction of the vane 573 within the drum body 51. Although not shown in the drawings, the laundry treating apparatus in accordance with the present disclosure may further include a drum drive unit configured to rotate the drum.

The laundry treating apparatus in accordance with the present disclosure may further include a passage unit (or passage) 8 configured to move the water inside the drum body 51 toward an upper region of the drum from a lower region of the drum and a filter unit or filter 9 configured to configured to filter the water drawn into the passage unit and exhaust the filtered water. The passage unit 8 may include a passage body 81 extending from the lower region of the drum toward the upper region and an inlet passage 811 provided in the passage body 81 and configured to supply water to the filter unit 9. The passage body 81 may be fixed to the drum body 51 and may define an inner circumferential surface of the drum.

Figure 2:
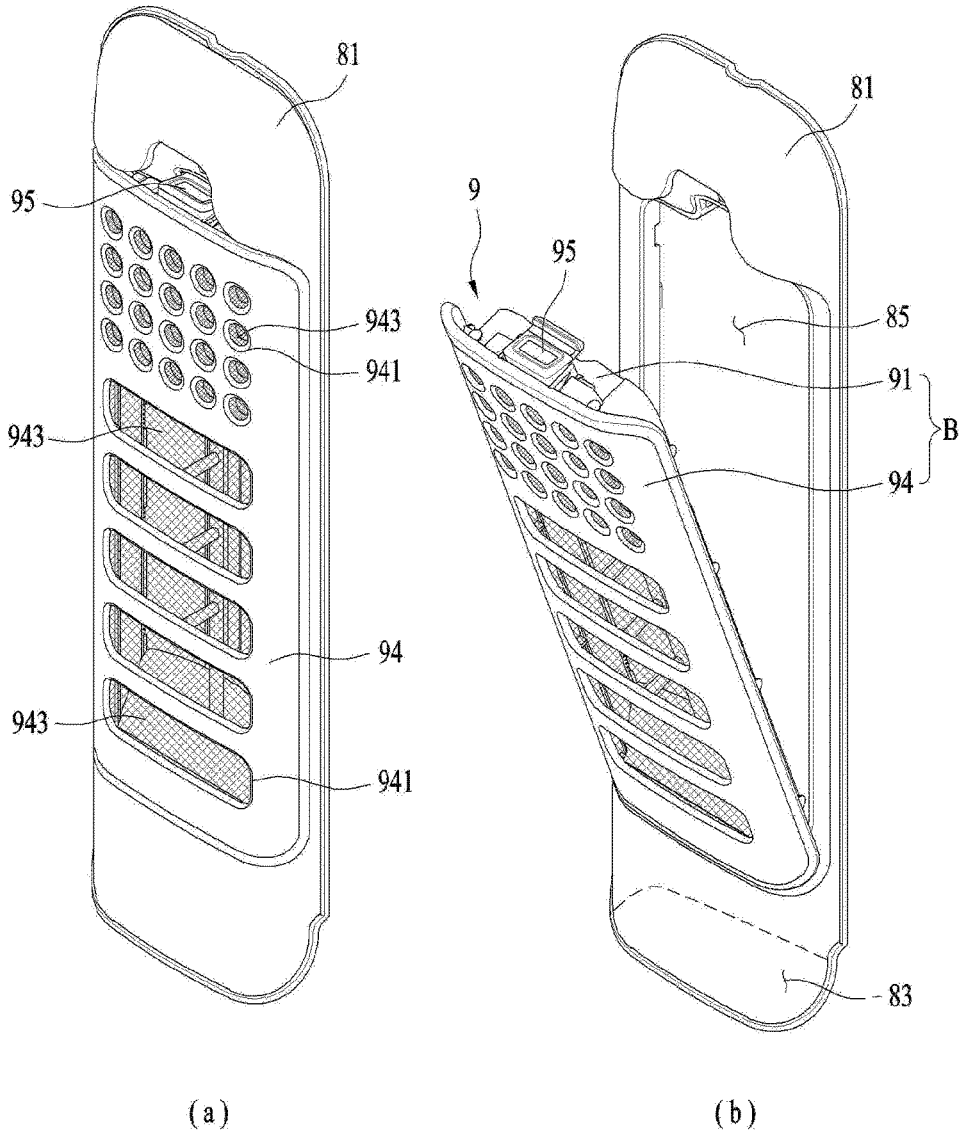
FIG. 2 is a diagram illustrating a filter unit and a passage unit.

As shown in FIG. 2, the passage body 81 may include an open portion (or opening) 83 for supplying water to the inlet passage 811; and a detaching portion 85 allowing the filter unit 9 to be detachably coupled thereto. The passage body 81 may be provided in a hexahedron shape. In this instance, the open portion 83 may be provided as a hole penetrating a bottom surface of the passage body 81. The detaching portion may be provided as a hole formed in a surface toward the rotation center of the drum 5 and in which the filter unit 9 is inserted.

When the passage 8 is configured to define an inner circumferential surface of the drum body 51, the passage body 81 may be made of the same material as the drum. For example, when the drum 5 is made of stainless steel, the passage body 81 may be also made of stainless steel. When the material of the drum 5 is the same with that of the passage body 81 forming the inner circumferential surface of the drum, a sense of design unity may be provided so as to enhance an internal aesthetic sense of the laundry treating apparatus.

The effect mentioned above may be realized by the passage body 81 made of plastic or the like and a body cover (82, see FIG. 1) made of the same material with the drum and configured to cover a surface of the passage body 81 (cost reduction). In this instance, the body cover 82 may be provided in only one of the surfaces of the passage body that defines the inner circumferential surface of the drum body 51.

The body cover 82 may be made of a material that has the same metal base as the drum body 51 but not the same exact material as the drum body 51, or may be made of the completely same material. In other words, a composition of the stainless steel used in manufacturing the drum body 51 may be different from a composition of the stainless steel used in manufacturing the body cover 82.

When the drum body 51, the agitator unit 57 and the passage unit 8 are made of the same material, the design unity can be maximized. The filter unit 9 may include a body (B) coupled to the passage body 81 via the detaching portion 85, an inlet 913 provided in the body (B) and configured to guide the water supplied to the inlet passage 811 to the body (B), a filter 943 configured to filter the water drawn into the body (B) and guide the filtered water to the drum body 51, and a handle 95 detachably coupling the body (B) to the passage body 81.

Figure 3:
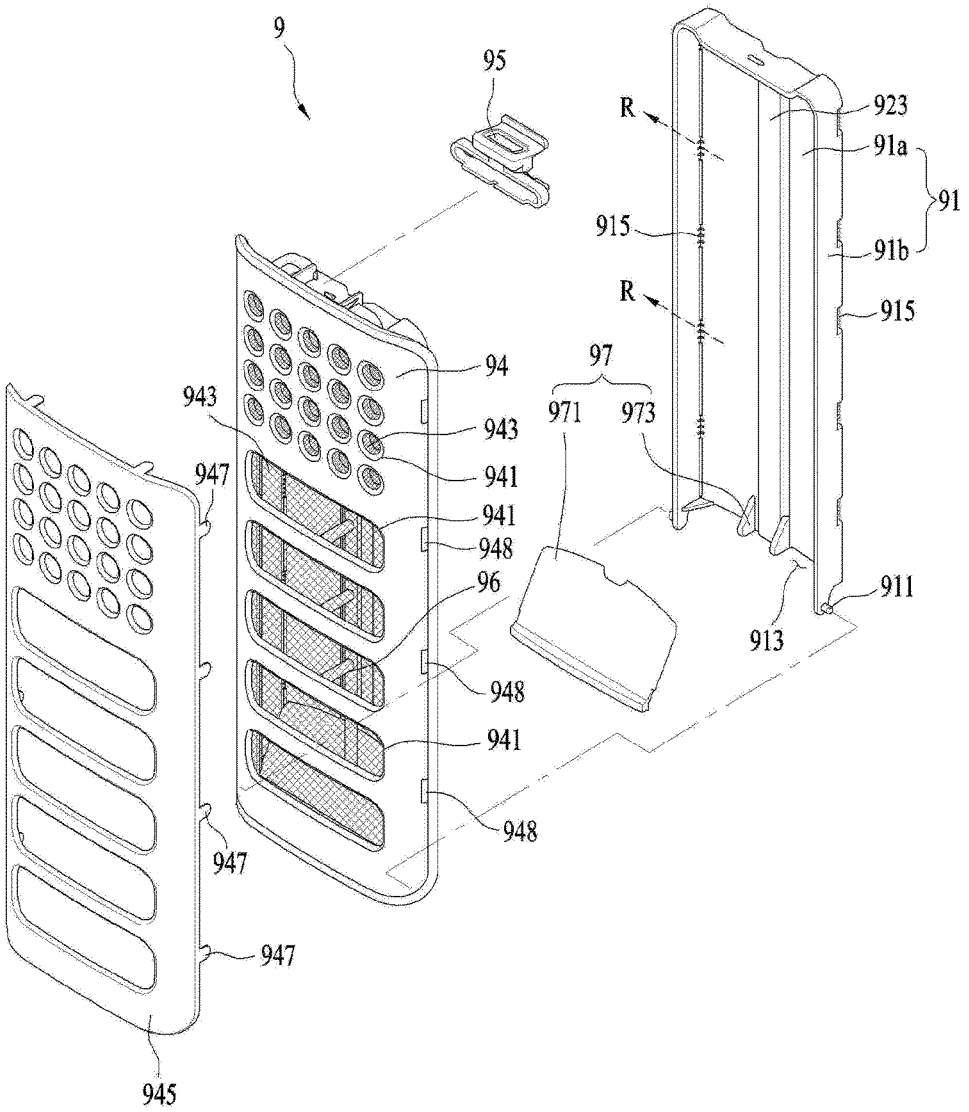
FIGS. 3 and 4 are diagrams illustrating one embodiment of the filter unit.

As shown in FIG. 3, the body (B) may include a first body 91 arranged in the passage body 81 and a second body rotatably provided in the first body 91 and configured to support the filter 943. The first body 91 and the second body 94 may be coupled to each other by a hinge 911. Accordingly, a user may be able to remove foreign substances stored in the body (B) by rotating the first body 91 away from the second body 94.

The first body 91 may include a base 91*a* parallel with the passage body 81; and a flange 91*b* projected from the base 91*b* toward the second body 94 to surround the filter 943. In this instance, the inlet 913 may penetrate the flange 91*b*.

The second body 94 may be coupled to the first body 91 and configured to form the inner circumferential surface of the drum body 51. A plurality of through holes 941 may be provided in the second body 94 to allow the inside of the body (B) to communicate with the drum 5. In this instance, the filter 943 may be provided as a mesh provided in the through holes 941.

The filter 943 may be provided on only one of the surfaces formed by the body (B) which defines the inner circumferential surface of the drum 5. When the filter 943 is provided on only the surface forming the inner circumferential surface of the drum 5, the pressure of the water exhausted from the filter 943 may be enhanced effectively, compared with a related case where the filter is provided in surfaces of the body (B).

When the pressure of the water filtered through the filter 943 becomes high, water may be strongly injected over the laundry stored in the drum during the rotation of the agitator unit 57. Accordingly, a laundry treating apparatus having a high washing performance may be provided.

A reverse-current preventing unit or flap 97 may be provided in the inlet 913 and the reverse-current preventing unit 97 may be provided on the first body 91 or the second body 92 as a means for opening and closing the inlet 913. The reverse-current preventing unit 97 shown in FIG. 3 may include a valve body 971 rotatably provided in the second body 94 and configured to open and close the inlet 913 and a stopper 973 provided in the base 91*a* of the first body and configured to prevent the valve body 971 from being rotated toward outside the body (B). The valve body 971 may be made of an elastic material such as rubber.

A support portion (or support) 96 configured to maintain a gap between the first body 91 and the second body 94 may be provided in the first body 91 or the second body 94. In other words, the support portion 96 may be projected from one of the first and second bodies 91 and 94 toward the other one.

According to FIG. 3, the support portion 96 may be provided in a cylinder shape. The support portion 96 may be formed in any shape if it is capable of maintaining the gap between the first body 91 and the second body 94.

Generally, the first body 91 and the second body 94 may be made of a soft and light material such as plastic, not steel. This may minimize an inertia moment of the drum 5 by lightening the weight of the drum 5 as much as possible. In this instance, the shape of the first and second bodies 91 and 94 might be deformed or damaged by severe vibration generated in the drum 5, the centrifugal force of the rotating drum at a high speed, the impact applied to the laundry held in the drum 5, and other diverse causes, for example.

If the first body 91 and the second body are pushed toward each other, the amount of water flowing into the filter unit 9 may decrease and the filter unit 9 may fail to perform its function. Accordingly, the support portion 96 may keep the gap between the first body 91 and the second body 94, so that the strength of the filter unit 9 may be reinforced and the volume of the filter unit 9 may be maintained so as to secure the amount of the water drawn into the filter unit 9.

According to FIG. 3, the support portion 96 may be provided in the second body 94. The support portion 96 may be projected from the second body 95 to contact with the first body 91. The filter unit 9 having the structure mentioned above may further include an outlet 915 configured guide the water containing the foreign substances outside the body (B) in a spin-dry cycle configured to drain water from the laundry to the tub by rotating the drum.

The outlet 915 provided in the filter unit may exhaust the water containing the foreign substances in a rotation locus contact direction (R) of the drum 5. In other words, the outlet 915 may be provided in a flange 91*b* forming a lateral surface of the first body 91.

The second body 94 forming the inner circumferential surface of the drum body 51 may be made of the same material as the drum body 51 so as to form design unity. In other words, the drum body 51 and the agitator unit 57 may be made of stainless steel.

The effect mentioned above may be realized by providing a cover 945 made of the same material as the drum on the surface of the second body 94. The cover 945 may cover only the surface defining the inner circumferential surface of the drum body 51, out of the surfaces of the second body 94. In this instance, the drum body 51, the agitator unit 57, and the cover 945 may be made of the same material (stainless steel or the like).

The cover 945 and the drum body may be made of the same material or made of the same material-based metal, but not the same material. In other words, the cover 945 may be made of a composition of the stainless steel used in manufacturing the drum body 51 different from a composition of the stainless steel used in manufacturing the cover 945.

When the second body 94 forms the inner circumferential surface of the drum body 51, the cover 945 may be provided in the same shape as the second body 94. To couple the second body 94 and the cover 945 to each other, a coupling projection 947 may project from the cover 945 toward the second body 94 and a coupling hole 948 may be provided in the second body 94 so that the coupling projection 947 may penetrate the coupling hole 948.

Figure 4:
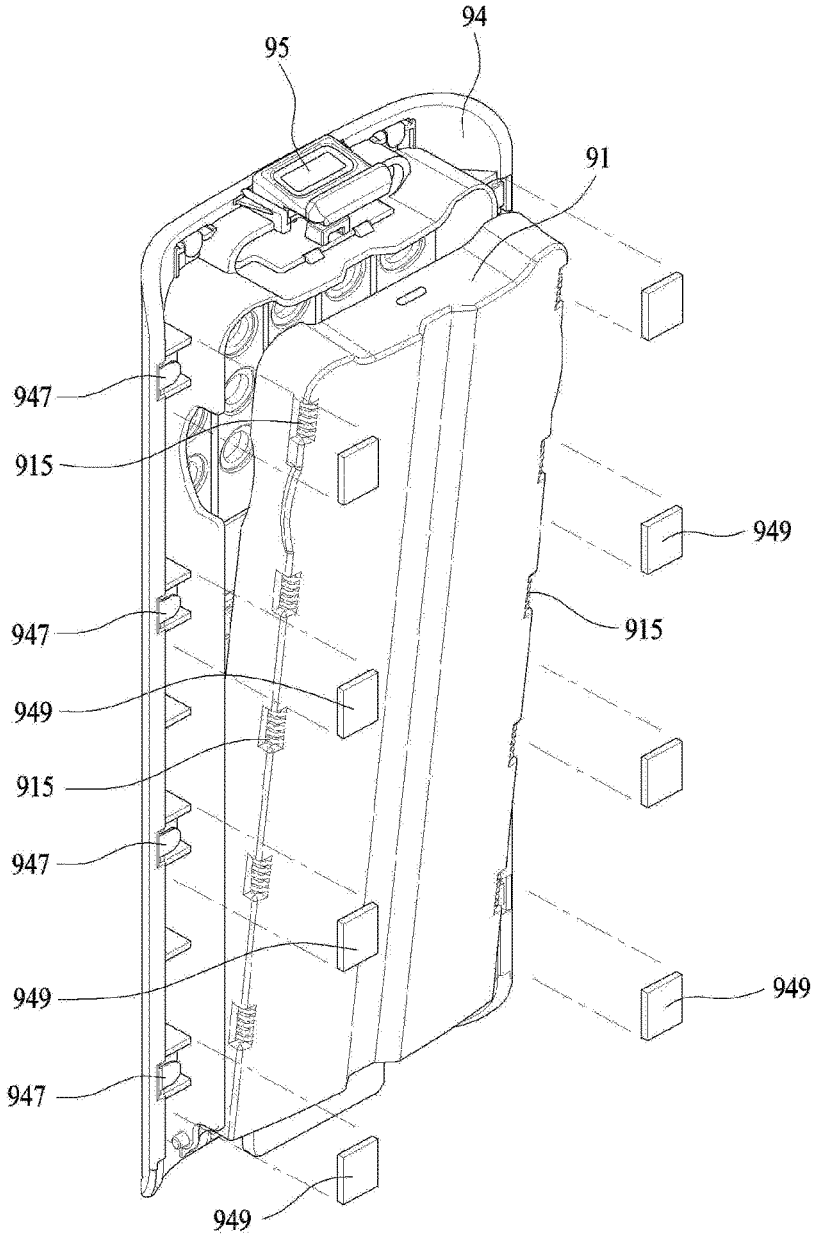

As shown in FIG. 4, the coupling projection 947 may be inserted in the coupling hole 948 and bent to fix the cover 954 to the second body 94. To prevent safety accidents, the coupling projection 947 may be prevented from being exposed outside by a coupling hole cover 949. The coupling hole cover 949 may be detachably fixed to a rear surface of the second body 94.

Hereinafter, referring to FIGS. 5 through 8, another embodiment of the filter unit 9 will be described. As mentioned above, when the agitator unit 57 is rotated in the drum 5, the water pushed by the agitator unit 57 may be drawn into the passage unit 8 provided in an inner wall of the drum in the laundry treating apparatus.

The water drawn into the passage unit 8 may be filtered by the filter unit 9 detachably provided in the passage unit 8. More specifically, the water may be filtered by the filter 943 provided in the inner wall of the drum 5 to be re-supplied to the drum 5 or guided by the outlet 915 to be re-supplied to the tub 3.

When such a process is repeated, a large amount of water inside the drum may be supplied to the filter unit 9 and supplied to the drum 5 again to be circulated. Hence, the circulated water may be filtered by the filter unit 9.

Accordingly, foreign substances such as dirt and lint contained in the water held in the tub after being separated from the laundry may be filtered by the filter unit 9. The laundry may be kept in a clean state where the foreign substances, dirt and lint (hereinafter, the foreign substances) are removed from tub 3.

However, when the body (B) forming the passage of the filter unit is provided smooth as shown in FIG. 3, the water supplied to the filter unit 9 may pass the body (B) with no resistance and be re-supplied to the drum 5. In other words, the water drawn into the filter unit 9 may be supplied to the tub 3 as it is without changing the passage and the water may remain in the filter unit 9 for a relatively short time.

Moreover, the flow rate of the water drawn in the filter unit 9 may not be lowered, so that a change of rate of accumulating foreign substance contained in the water may be reduced. Even when remaining in the body (B) after being filtered by the filter 943, the foreign substances may not be fixed to the body (B). The foreign substances may be separated from the inner wall of the body (B) again and may be resupplied to the body (B).

The foreign substances floating in the body (B) may be more likely to re-enter into the drum 5 after escaping the filter unit 9. Also, the foreign substances not filtered in the body (B) may be collected in the bottom of the filter unit 9, when all of the water is exhausted from the filter unit 9.

Moreover, when the filter unit 9 in accordance with the embodiment is provided with the structure illustrated in FIGS. 2 and 3, the foreign substances may accumulate near the inlet 913. Accordingly, when the filter unit 9 filters the water of the drum for a long time period, the foreign substances may be collected only in the bottom of the body (B) and the foreign substances may not be stuck to most areas of the body (B). Even if the entire area of the body (B) is enlarged, the amount of the foreign substances accommodated by the filter unit 9 cannot be increased to a preset value or more.

Also, when accumulating near the inlet 913, foreign substances may interfere with the lead-in of the water into the filter unit 9 and may to escape into the inlet 913. In other words, if the amount of the foreign substances stored in the body (B) increases in spite of a stopper 973, the valve body 971 may be rotated outside the body (B) to as to exhaust the foreign substances inside the body (B) outside.

Figure 5:
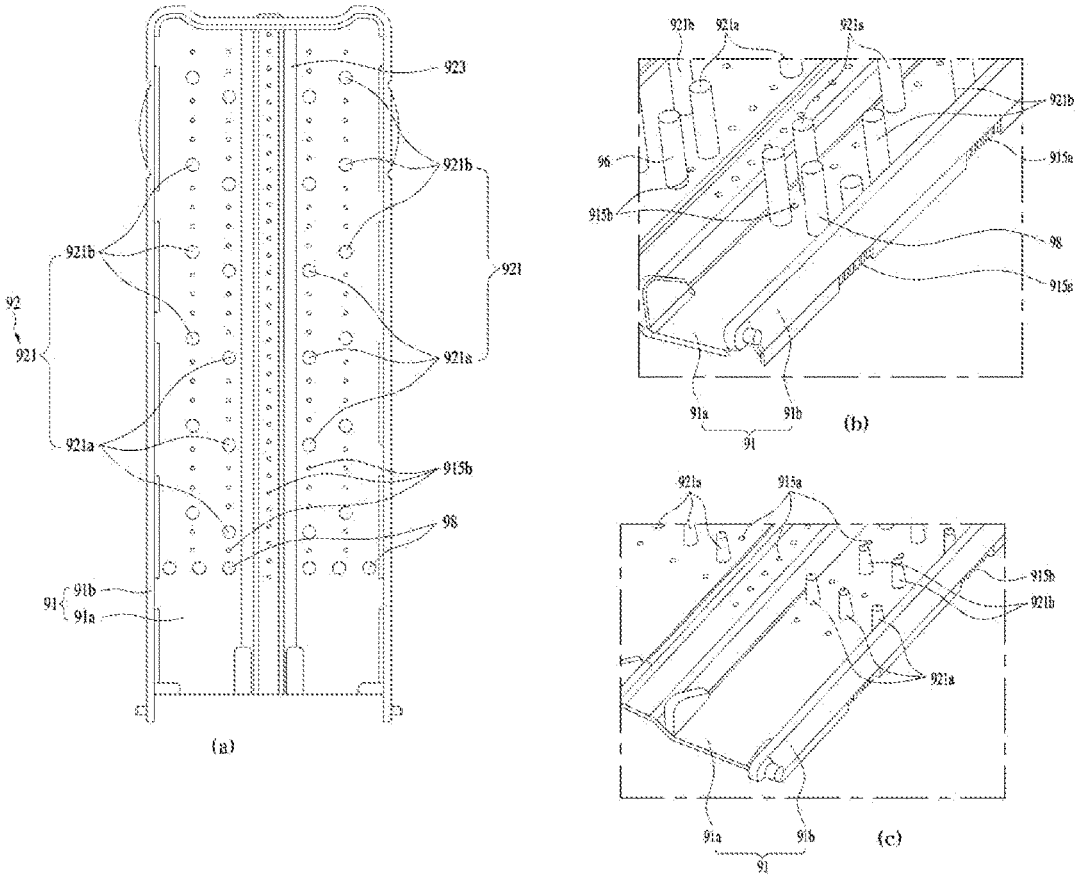
FIGS. 5 through 7 are diagrams illustrating diverse embodiments of a projected unit.
Figure 6:
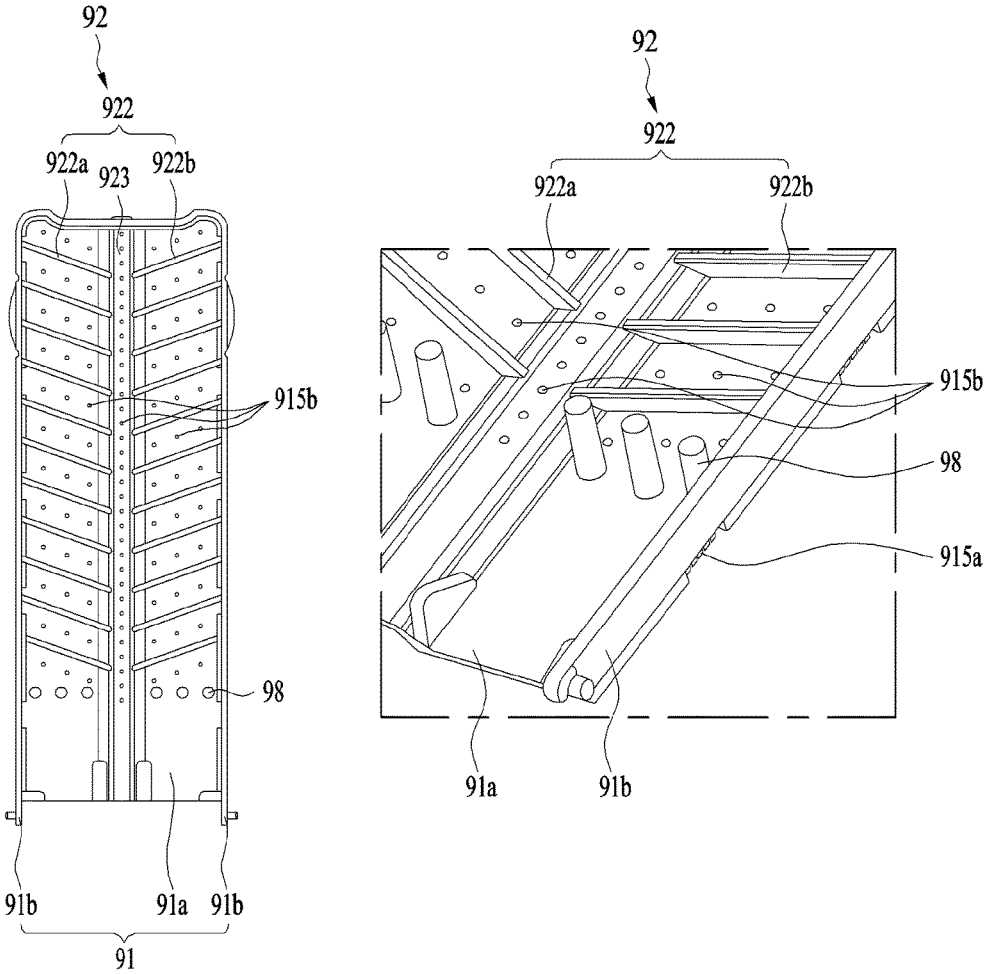
Figure 7:
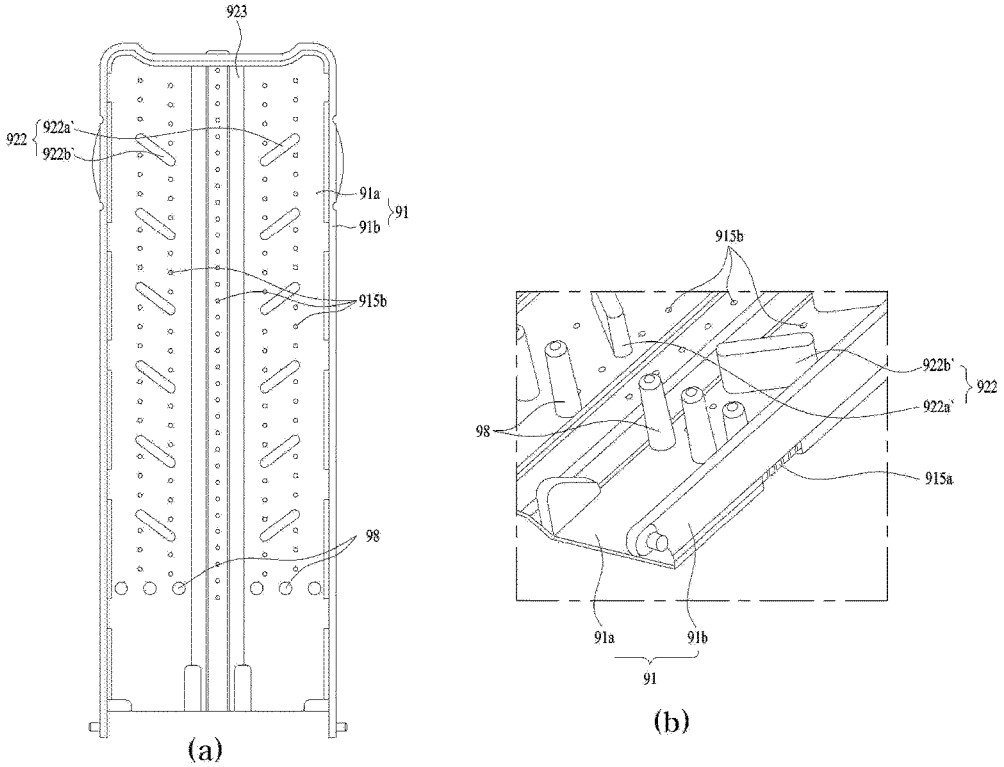

Accordingly, the function of the filter unit 9 may be deteriorated enough to cause contamination of the laundry. To prevent contamination, the body (B) may include a projected unit (or projection) 92 projected from an inner surface as shown in FIGS. 5 through 7. The projected unit 92 may be projected from the body (B) to hold the filtered foreign substances in the body (B). Also, the projected unit 92 may reduce the flow rate of the water drawn into the body (B) or change a stream line of the water so as to separate the foreign substances contained in the water to the filter unit 9.

The projected unit 92 may distribute the foreign substances on the surface of the body (B) uniformly by fixing the foreign substances separated from the water and also increase the amount of the foreign substances accommodated by the body (B). In addition, the projected unit 92 may stop the foreign substances from separating outside the filter unit 9 by preventing the foreign substances filtered from the water from entering into the body (B).

As shown in FIGS. 5 and 7, the projected unit 92 may be projected from the first body 91 of the body (B). As the second body 94 is rotatably provided in the first body 91 and the first body 91 functions as the center of the filter unit 9, the projected unit 92 provided in the first body 91 may prevent the free escaping of the foreign substances filtered by the filter unit 9 during the rotation of the second body 94 when the second body 94 is separated from the first body 91.

The projected unit 92 may occupy much of the volume in the first body, so that the projected unit 92 may be provided in the base 91*a* of the first body 91. The base 91*a* may occupy more area than the flange 91*b* and more projected units 92 may be provided. The projected unit 92 may also be provided in the second body 94. Alternatively, the projected unit 92 may be provided in the second body 94 or flange 91*b* of the first body 91. That is, the projected unit 92 may be provided in any portion of the body (B), only if capable of increasing the passage resistance of the water drawn into the filter unit 9.

FIG. 9 illustrates that the projected unit 92 is provided as a plurality of projections (or posts) 921 formed along one surface of the body (B). The projections 921 may be dispersed along a longitudinal direction and a transverse direction of the body (B). In other words, the projections 921 may be distributed along one surface of the body (B). The projections 921 may be distributed along one surface of the body uniformly or irregularly. The size and shape of the projections 921 are not limited, and may have any number of different forms.

The projection 921 may be projected from one surface of the body (B), perpendicular to the flow direction of the water drawn into the body (B). The water drawn in the filter unit 9 may collide with the projections 921 to slow down the flow rate. While the water is flowing along an outer circumferential surface of the projection 921, the stream line of the water may be changed to generate agitation.

Accordingly, the projections 921 may facilitate the separation of the foreign substances contained in the water so that the foreign substances can be attached to the filter 943 or clogged to the projection 921. Meanwhile, the projection shown in FIGS. 5(*a*) and (*b*) may include a first projection 921*a* provided along a first surface of the body; and a second projection 921*b* alternated not to be collinear with the first projection 921*a*.

More specifically, the first projection 921*a* and the second projection 921*b* may be sequentially arranged in the body (B). In other words, the first projection 921*a* and the second projection 921*b* may be alternatively arranged along a longitudinal direction of the body (B). The first and second projections 921*a* and 921*b* may not be provided on the same stream not to be coincident with the flow direction of the water.

As the first projection 921*a* and the second projection 921*b* are not provided on the same stream line, the water passing the first projection 921*a* without collided against the first projection 921*a* collide with the second projection 921*b*. The water drawn into the filter unit 9 may collide with the first projection 921*a* and then generate an eddy. The eddy may facilitate more collisions of the water against the second projection 921*b*.

Moreover, the eddy may generate an effect of lowering the flow rate of the water moving the body (B), so that the foreign substances contained in the water can be separated from the water easily and that the filtering ability of the filter unit 9 may be enhanced noticeably. Meanwhile, as shown in FIG. 5 part (*c*), the first projection 921*a* may be provided in parallel with one surface of the inlet 913. That is, a plurality of first projections 921*a* may be spaced a preset distance apart from each other in parallel with the transverse direction of the body (B). The plurality of the first projections 921*a* may be spaced a preset distance from each other in a direction perpendicular to the flow direction of the water drawn via the inlet 913.

The plurality of the second projections 921*b* may be spaced a preset distance from each other in a parallel direction to the flow direction of the water and in the same direction with the parallel direction of the first projections 921*a*. The first projections 921*a* and the second projections 921*b* may be alternatively arranged, not to be provided on the same line. The number of the first projections 921*a* may be different from that of the second projections 921*b*.

FIG. 6 illustrates another embodiment of the projected unit 92. The projected unit 92 may include a plurality of ribs 922 projected from the body (B), spaced a preset distance from each other. The ribs 922 may be projected from the body (B) and configured to lower the flow rate of the water flowing in the body (B). When water is drawn into or released from the filter unit 9, the ribs 922 may consistently contact with the water inside the filter unit 9 and collide against the water so as to filter the foreign substances contained in the water. Moreover, the filtered foreign substances may accumulate in a space between the ribs to be attached.

Meanwhile, the ribs 922 may be inclined with respect to the direction of the water drawn into the body. Specifically, the ribs 922 may be inclined in the reverse direction of the water flow direction to the body (B). Alternatively, the ribs 922 shown in FIG. 6 may be inclined along the water flow direction to the body (B). In other words, the ribs may be inclined upward.

When the water is drawn into the filter unit 9, the water may be dispersed and moved toward the flange 91*b* along the ribs. The, the water may be guided to the end of the body (B) by the surface tension to be drawn into the filter unit 9. At this time, when the amount of the flowing water in the body (B) decreases as the water is released from the filter unit 9, foreign substances may be clogged to the ribs 922 and attached thereto.

As the filter unit 9 is attached to one surface of the drum body 51, the water may be drawn to the upper portion of the body (B) and then released to the lower portion. After that, the foreign substances contained in the water may be caught by the ribs 922 inclined in the reverse direction only to be hooked and stuck to the ribs 922.

When the ribs 922 are inclined, the foreign substances may accumulate easily and be held in a direction toward the lower portion. In this instance, the ribs 922 may include a first rib 922*a* inclined from a central line 923 of the base parallel with the water flow direction toward one flange 91*b* along the water flow direction to the body (B); and a second rib 922*b* inclined from the central line toward the other flange 91*b* along the water flow direction to the body (B).

The central line 923 may be projected into the first body 91. This may be for the assembling sake of the filter body 9 and the drum body 91 and the central line 923 may be provided as a virtual line passing the central line of the first body.

As shown in FIG. 6, the first rib 922*a* and the second rib 922*b* may be extended from the central line to the flange 91*b*. The first rib 922*a* and the second rib 922*b* may be connected with each other at the central line 923. In other words, the first rib 922*a* and the second rib 922*b* may be provided serially, so that foreign substances may be accumulate and be held in the central line 923 provided between the first rib 922*a* and the second rib 922*b*.

Referring to FIG. 7, the first rib 922*a*' and the second rib 922*b* may be independently provided. Also, the first rib 922*a*' and the second rib 922*b*' may be spaced a preset distance from each other.

Accordingly, water may be able to flow between the first rib 922*a*' and the second rib 922*b*' smoothly. The water may also be able to flow between the first rib 922*a*' and the flange 91*b* and between the second rib 922*b*' and the flange 91*b* smoothly.

The water drawn into the filter unit 9 may be drawn from one end to the other end of the body (B) smoothly. To enhance the foreign substance filtering and holding ability, the areas of the first and second ribs 922*a*' and 922*b*' may be increased. In other words, the first rib 922*a*' and the second rib 922*b*' may be projected as far as the gap between the first body 91 and the second body 94.

Referring to FIGS. 5 through 7, the body (B) may further include separation preventing unit or projection 98 to prevent the foreign substances held to the projected unit 92 from be separated and moved into the inlet 913 again. The separation preventing unit 98 may be projected along the inlet 913 and the projected unit 92 may be arranged in a rear portion with respect to the separation preventing unit 98. The rear portion may be determined with respect to the water flow direction into the inlet 913.

The separation preventing unit 98 may prevent the foreign substances from moving toward the inlet 913 when the foreign substances attached to the projected unit 92 or the filter 943 are separated by the vibration of the drum 5. The separation preventing unit 98 may be formed in any shape, only if capable of preventing the foreign substances from moving to the inlet 913.

Referring to FIGS. 5 through 7, the base 91*a* may further include a second outlet 915*b* penetrating the base 91 and configured to release water in a radial direction of the drum rotation locus. The second outlet 915*b* may be configured to release the water held in the filter unit 9 outside the drum 5 by using the centrifugal force generated when the drum is rotated at a high speed in the spin-dry cycle of the laundry treating apparatus performs.

While the water is released via the second outlet 915*b*, the foreign substances held in the body (B) may be attached to the base 91*a* and held to the projected unit 92 provided in the base 91*a* more efficiently. Also, the foreign substances may be held to the projected unit 92 and may accumulate on the projected unit 92, not to be separated.

The second outlet 915*b* may be provided between the projected unit 92, and more specifically between the projections 915*b*. The projected area of the projections 92 from the body (B) may have a consistent ratio to the entire area of the body (B). In other words, the area of the projected unit 92 may be determined according to a preset ratio to the area of the first body 91 in which the projected unit 92 is projected.

If the projected unit 92 is projected to occupy most area of the first body 91, the water flow to the body (B) may be interfered with enough to deteriorate the function of the filter unit 9. If the projected unit 92 is projected too little, compared with the area of the first body (B), the foreign substance holding and filtering ability may be deteriorated. Accordingly, the projected unit 92 may have a preset area ratio with respect to the body (B) which is a parent area of the projected unit 92.

Figure 8:
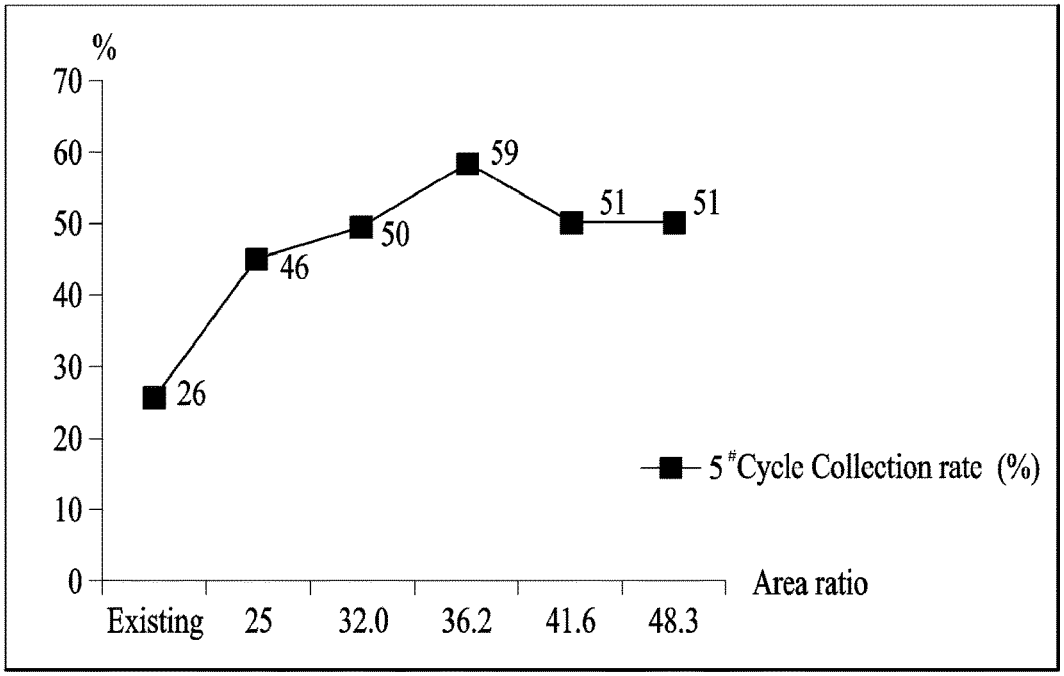
FIG. 8 is a diagram illustrating the result of experiments on optimality of an area ratio of a body including the projected unit to the projected unit.

FIG. 8 illustrates the amount of the foreign substances collected in the filter unit 9 as the area occupied by the projected unit 92 is varied. A horizontal axis is a percentage of the area occupied by the projected unit 92 with respect to the body (B) and a vertical axis is a rate of foreign-substance collection.

Referring to FIG. 8, the foreign-substance filtering and holding ability may be enhanced remarkably when the projected unit 92 is projected over 25% with respect to the area of the first body 91. In other words, when the area of the first body 91 in which the projected unit 92 is projected is 25% or more, the rate of the foreign substance filtering and holding rises remarkably, compared with the rate less than 25%. There is minute difference near 50% and the effect is maintained.

When the projected unit 92 occupies 25% of the first body 91 area, the foreign substance collecting rate rises remarkably. When the area of the projected unit is over 50%, the volume of the water flow to the body (B) may be reduced or too much passage resistance may be generated. Accordingly, it can be expected that the foreign substance collecting rate falls remarkably.

Accordingly, it may be said that the projected unit 92 is able to collect and filter remarkably more foreign substances than the projected unit having the other areas, when the area of the projected unit 92 is a quarter or more of the first body 91 area.

When the projected unit 92 is provided as the projections 921, the area of the projected unit may be a cylindrical surface area (see FIG. 5). When the projected unit 92 is provided as the ribs 922, the area of the projected unit may be a surface area of the ribs 922.

The area of the rib (B) may be the area of a surface where the projected unit 92 is provided. When the projected unit 92 is provided on the base 91*a* of the first body, the area of the projected unit may be the area of the base 91*a*.

A laundry treating apparatus may comprise a tub holding water; a drum mounted in the tub and holding laundry; a passage provided in the drum and configured to provide a flow passage of the water; an agitator rotatably provided in the drum and configured to move at least a predetermined amount of the water held in the drum when being rotated; and a filter device configured to filter the water flowing along the passage, wherein the filter device includes a body defining a storage space of a foreign substance; an inlet configured to draw the water into the body from the passage; a filter provided in the body and configured to filter foreign substances from the water drawn into the body and supply the water to the drum; and a projected boss projected from the body and configured to hold the filtered foreign substances to the body, wherein an area of the projected boss is between 25% and 50% of the body area.

The projected boss may include a plurality of projections projected along one surface of the body. The plurality of projections may include a first projection provided along a first surface of the body; and a second projection spaced a preset distance apart from the first projection on the first surface and alternatively arranged with the first projection not to be in the same line with the first projection, wherein the first projection and the second projection are projected sequentially.

The projected boss may include a plurality of ribs projected from the body and spaced a preset distance apart from each other. The ribs may be projected in a perpendicular direction to the water flow direction to the body. The ribs may be inclined with respect to the water flow direction to the body.

The ribs may be inclined along the water flow direction to the body. The body may include a base provided parallel to the passage unit and a flange projected from each of both sides of the base and defining a water flow passage and a storage space of foreign substances, with the inlet passing therethrough, and the projected unit may be projected from the base. The projected unit may include a plurality of ribs projected from the body and spaced a preset distance from each other, and the ribs may connect both ends of the flanges with each other.

The projected unit may include a plurality of ribs projected from the body and spaced a preset distance from each other, and the ribs may include a first rib inclined from a central line of the base parallel to the water inflow direction toward one flange along the water flow direction to the body and a second rib inclined from the central line toward the other flange along the water flow direction to the body. The first rib and the second rib may be extended from the central line to the flange and connected with each other at the central line.

The first rib and the second rib may be separated from each other. The first rib and the second rib may be extended from the central line toward the flange, spaced a preset distance from the flange. The base may further include a separation preventing unit projected along the inlet, and the projected unit may be provided in a rear portion of the passage, compared with the separation preventing unit.

The body may include an outlet configured to dispense the water drawn into the body, and the outlet may include a first outlet penetrating the flange and configured to dispense the water in a contact direction of drum rotation locus; and a second outlet penetrating the base and configured to dispense the water in a radial direction of the drum rotation locus. The second outlet may be provided between the projected unit.

The filter may be provided only in one surface forming an inner circumferential surface of the drum out of the surfaces defined by the body. The body may include a first body detachably provided in the passage unit and comprising the base and the flange; and a second body rotatably coupled to the first body and forming an inner circumferential surface of the drum, with the filter fixed thereto.

The laundry treating apparatus may further include a cover made of the same material as the drum and fixed to a surface of the second body. The laundry treating apparatus may further include a reverse-current preventing unit provided in the first body or the second body and configured to open and close the inlet, rotatable only toward the inside of the body. The passage unit may include a passage body extended from a lower portion toward an upper portion of the drum and forming an inner circumferential surface of the drum, made of the same material with the drum; and an inlet passage configured to guide the water drawn into the passage body to the inlet.

The laundry treating apparatus may include a filter device to filter water. Furthermore, the laundry treating apparatus may uniformly distribute lint in a filter device to filter water.

Still further, the laundry treating apparatus may uniformly distribute lint in a filter device, not agglomerating the lint at one spot. Still further, the laundry treating apparatus may increase passage resistance in a filter device to allow the filter device to filter the lint contained in the water, when water flows in or out from the filter device.

Still further, the laundry treating apparatus may prevent the lint remaining after being filtered in the filter device from being redistributed to the drum or tub. Still further, the laundry treating apparatus may prevent lint from flowing or floating in the filter device for a long time by releasing the water from the filter device quickly.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a tub configured to hold water;

a drum provided in the tub, the drum being rotated around a vertical axis and configured to hold laundry;

a passage unit provided in an inner wall of the drum and configured to provide a flow passage of the water;

an agitator unit rotatably provided in the drum and configured to move at least a part of the water held in the drum to the passage unit when being rotated; and a filter unit configured to filter the water flowing along the passage unit, wherein the filter unit comprises, a body defining a storage space;

an inlet provided in a lower portion of the body and configured to inflow the water into the body from the passage unit;

a filter provided in the body positioned above the inlet and configured to filter foreign substances from the water introduced into the body and discharge the water to the drum; and a projected unit projected from the body and configured to trap the foreign substances inside the body and arranged along a vertical direction of the body.

2. The laundry treating apparatus of claim 1, wherein the projected unit comprises a plurality of projections projected along one surface of the body wherein a cross-sectional area of the plurality of first projections is between 25% to 50% of a cross-sectional area of the body.

3. The laundry treating apparatus of claim 2, wherein the projections comprises, a first projection provided along one surface of the body; and a second projection spaced a preset distance apart from the first projection and alternatively arranged with the first projection not to be in the same line with the first projection, and the first projection and the second projection are projected sequentially.

4. The laundry treating apparatus of claim 2, wherein the projected unit comprises a plurality of ribs projected from the body and spaced a preset distance apart from each other.

5. The laundry treating apparatus of claim 4, wherein each of the plurality of ribs is perpendicular to the water flow direction in the body.

6. The laundry treating apparatus of claim 4, wherein each of the plurality of ribs is angled with respect to the water flow direction in the body.

7. The laundry treating apparatus of claim 6, wherein each of the plurality of ribs is angled to direct the water toward either side of the body.

8. The laundry treating apparatus of claim 1, wherein the body includes:

a base having a plate shape and provided parallel to the passage unit; and a flange projected from each edge of the base and defining a water flow passage and a storage space for the foreign substances, and having the inlet portion penetrating there through, and the projected unit is projected from the base.

9. The laundry treating apparatus of claim 8, wherein the projected unit comprises a plurality of ribs projected from the body and spaced a preset distance from each other, wherein each of the plurality of ribs connect both ends of the flanges with each other.

10. The laundry treating apparatus of claim 8, wherein the projected unit comprises a plurality of ribs projected from the body and spaced a preset distance from each other, wherein the plurality of ribs includes:

a first rib angled from a central line of the base parallel to the water inflow direction toward a first flange on a first side of the base along the water flow direction in the body; and a second rib inclined from the central line toward a second flange on a second side of the base along the water flow direction in the body.

11. The laundry treating apparatus of claim 10, wherein the first rib and the second rib extend from the central line to the first flange and second flange, respectively, are connected to each other at the central line, and are spaced a preset distance from the first flange and second flange, respectively.

12. The laundry treating apparatus of claim 10, wherein the first rib and the second rib are separated from each other by central line.

13. The laundry treating apparatus of claim 8, wherein the base further comprises a plurality of protrusions that protrude from the base, wherein the plurality of protrusions are provided closer to the inlet than the projected unit, and Wherein the plurality of protrusions prevent foreign substances from exiting through the inlet of the filter.

14. The laundry treating apparatus of claim 8, wherein the body further includes:

an outlet configured to discharge the water introduced into the body, wherein the outlet includes, a first outlet penetrating at least one of the first flange or the second flange and configured to discharge the water into the drum in a tangential direction of drum rotation locus; and a second outlet penetrating the base and configured to discharge the water into the drum in a radial direction of the drum rotation locus.

15. The laundry treating apparatus of claim 14, wherein the second outlet is provided between the projected unit.

16. The laundry treating apparatus of claim 1, wherein the body comprises a first body and a second body attached to the first body, the second body facing an inside of the drum, and wherein the filter is provided on only second body such that water flows from the storage space through the filter and into the drum.

17. The laundry treating apparatus of claim 8, wherein the body includes:

a first body detachably provided in the passage unit and including the base and the flanges; and a second body rotatably coupled to the first body and forming an inner circumferential surface of the drum, wherein the filter is affixed to the second body.

18. The laundry treating apparatus of claim 17, further including:

a cover fixed to a surface of the second body, wherein the cover is composed of a same material as the drum.

19. The laundry treating apparatus of claim 17, further including:

a reverse-current preventing unit provided in one of the first body or the second body and configured to open and close the inlet, wherein reverse-current preventing unit is rotatable only toward an inside of the body.

20. A laundry treating apparatus, comprising:

a tub configured to hold water;

a drum provided in the tub and configured to hold laundry;

a passage provided along a wall of the drum and configured to allow water to flow upwards from a bottom portion of the drum;

an agitator rotatably provided in the drum and configured to agitate the water in the drum; and a filter installed along the passage, wherein the filter comprises:

a body defining a storage space;

an inlet through which the water from the bottom portion of the drum may be introduced into the body; and a plurality of projections that extend from the body and are configured to trap the foreign substances inside the body.

* * * * *